US010603673B2

(12) United States Patent
Matsumoto et al.

(10) Patent No.: US 10,603,673 B2
(45) Date of Patent: Mar. 31, 2020

(54) SOLID FUEL PULVERIZING DEVICE AND METHOD FOR CONTROLLING SAME

(71) Applicant: MITSUBISHI HITACHI POWER SYSTEMS, LTD., Yokohama (JP)

(72) Inventors: Shinji Matsumoto, Tokyo (JP); Takuichiro Daimaru, Tokyo (JP); Kenichi Arima, Tokyo (JP); Taku Miyazaki, Tokyo (JP); Kazushi Fukui, Yokohama (JP); Hiroyuki Kobayashi, Yokohama (JP)

(73) Assignee: MITSUBISHI HITACHI POWER SYSTEMS, LTD., Yokohama (JP)

( * ) Notice: Subject to any disclaimer, the term of this patent is extended or adjusted under 35 U.S.C. 154(b) by 378 days.

(21) Appl. No.: 15/528,253

(22) PCT Filed: Aug. 24, 2015

(86) PCT No.: PCT/JP2015/073726
§ 371 (c)(1),
(2) Date: May 19, 2017

(87) PCT Pub. No.: WO2016/084436
PCT Pub. Date: Jun. 2, 2016

(65) Prior Publication Data

US 2017/0320066 A1 Nov. 9, 2017

(30) Foreign Application Priority Data

Nov. 28, 2014 (JP) ..... 2014-241591

(51) Int. Cl.
*B02C 25/00* (2006.01)
*B02C 23/04* (2006.01)
(Continued)

(52) U.S. Cl.
CPC ..... *B02C 23/04* (2013.01); *B02C 15/04* (2013.01); *B02C 25/00* (2013.01); *F23K 3/02* (2013.01); *B02C 2015/002* (2013.01)

(58) Field of Classification Search
CPC ..... B02C 25/00; B02C 15/04; B02C 15/02; B02C 2015/002; B02C 23/04; F23K 3/02
See application file for complete search history.

(56) References Cited

U.S. PATENT DOCUMENTS 6,467,707 B1 10/2002 Williams, Jr.
8,657,221 B2 * 2/2014 Matsumoto ..... B02C 15/04 241/119
2018/0280990 A1 * 10/2018 Oba ..... B22C 5/06

FOREIGN PATENT DOCUMENTS

JP 4-240310 8/1992
JP 5-49965 3/1993
(Continued)

OTHER PUBLICATIONS

German Office Action dated Nov. 23, 2018 in corresponding German Patent Application No. 112015005363.8 with English translation.

(Continued)

*Primary Examiner* — Faye Francis
(74) *Attorney, Agent, or Firm* — Wenderoth, Lind & Ponack, L.L.P.

(57) ABSTRACT

Provided is a solid fuel pulverizing device (100) provided with: a ventilation unit (30) configured to ventilate an interior of a housing (11) with primary air for supplying a solid fuel pulverized by a roller (13) to a classifier (16); a pressure detector (50) configured to detect an internal pressure of the housing (11) relative to a reference pressure; a flow rate detector (60) configured to detect a flow rate of the
(Continued)

primary air blown into the interior of the housing (11) by the ventilation unit (30); and a controller (40) configured to perform control and transition the solid fuel pulverizing device (100) to a stopped state upon the internal pressure detected by the pressure detector (50) being a predetermined pressure or higher and the flow rate of the primary air detected by the flow rate detector (60) being a predetermined flow rate or less.

20 Claims, 4 Drawing Sheets

(51) Int. Cl.

| | |
|---|---|
| ***F23K 3/02*** | (2006.01) |
| ***B02C 15/04*** | (2006.01) |
| *B02C 15/00* | (2006.01) |

(56) References Cited

FOREIGN PATENT DOCUMENTS

| | | |
|---|---|---|
| JP | 2000-28129 | 1/2000 |
| JP | 2000-297930 | 10/2000 |
| JP | 2002-143714 | 5/2002 |
| JP | 2007-61727 | 3/2007 |
| JP | 2008-157545 | 7/2008 |
| JP | 2012-7811 | 1/2012 |

OTHER PUBLICATIONS

International Search Report dated Nov. 17, 2015 in International (PCT) Application No. PCT/JP2015/073726 w/English translation.
Written Opinion of the International Searching Authority dated Nov. 17, 2015 in International (PCT) Application No. PCT/JP2015/073726 w/English translation.

* cited by examiner

SOLID FUEL PULVERIZING DEVICE AND METHOD FOR CONTROLLING SAME

TECHNICAL FIELD

The present invention relates to a solid fuel pulverizing device configured to pulverize a solid fuel, and a method for controlling the same.

BACKGROUND ART

A pulverizer that pulverizes a solid fuel such as coal into a fine powder smaller than a predetermined particle size has been known (refer to Patent Document 1, for example).

Patent Document 1 discloses a method for detecting rapid combustion and stopping a pulverizer when rapid combustion similar to dust explosion occurs inside the pulverizer. Specifically, Patent Document 1 discloses a method for detecting a pressure differential by subtracting the pressure of an upper internal portion inside a housing of the pulverizer from the pressure inside a hot air duct that supplies hot air to the pulverizer interior, and stopping the pulverizer when this pressure differential is negative.

CITATION LIST

Patent Document

Patent Document 1: Japanese Unexamined Patent Application Publication No. 2002-143714A

SUMMARY OF INVENTION

Technical Problem

The pulverizer disclosed in Patent Document 1 stops once the pressure of the upper internal portion inside the housing of the pulverizer has decreased below the pressure inside the hot air duct, and a state in which the pressure differential is negative has been clocked by a timer for a certain period of time. As a result, the pulverizer cannot be stopped until a certain period of time has been clocked by the timer, even if rapid combustion occurs inside the pulverizer.

Further, a pressure detector that detects the pressure of the upper internal portion inside the housing of the pulverizer is disposed inside the housing where fine powder exists, causing failure to readily occur compared to other spaces where fine powder does not exist.

Nevertheless, the pulverizer disclosed in Patent Document 1 may be mistakenly stopped when failure occurs in the pressure detector that detects the pressure of the upper internal portion inside the housing of the pulverizer.

In light of the foregoing, it is an object of the present invention to provide a solid fuel pulverizing device configured to immediately detect rapid combustion that occurs inside the solid fuel pulverizing device and, at the same time, prevent false detection caused by failure of a detector configured to detect rapid combustion, and a method for controlling the solid fuel pulverizing device.

Solution to Problem

The present invention adopts the following means in order to solve the abovementioned technical problem.

A solid fuel pulverizing device according to an aspect of the present invention is a device configured to pulverize a solid fuel. The device include a rotary table, a roller, a classifier, a housing, a ventilation unit, an internal pressure detector, a primary air flow rate detector, and a controller. The rotary table is configured to rotate by a driving force from a drive unit. The roller is configured to pulverize the solid fuel supplied from a fuel supply unit to the rotary table. The classifier is configured to classify the solid fuel pulverized by the roller into pulverized fuel smaller than a predetermined particle size. The housing houses the rotary table, the roller, and the classifier. The ventilation unit is configured to ventilate an interior of the housing with primary air for supplying the solid fuel pulverized by the roller to the classifier. The internal pressure detector is configured to detect an internal pressure of the housing relative to a reference pressure. The primary air flow rate detector is configured to detect a flow rate of the primary air blown into the interior of the housing by the ventilation unit. The controller is configured to perform control and transition the solid fuel pulverizing device to a stopped state upon the internal pressure detected by the internal pressure detector being a predetermined pressure or higher and the flow rate of the primary air detected by the flow rate detector being a predetermined flow rate or less.

According to the solid fuel pulverizing device of the aspect of the present invention, when rapid combustion occurs inside the housing that houses the rotary table, the roller, and the classifier, the internal pressure of the housing rises due to the rapid combustion and, as a result, the flow rate of the primary air blown into the housing interior decreases.

The solid fuel pulverizing device according to this aspect performs control and transitions to a stopped state when, due to the rapid combustion that occurred in the housing interior, the internal pressure of the housing rises to a predetermined pressure or higher relative to the reference pressure, and the flow rate of the primary air decreases to a predetermined flow rate or less.

According to the solid fuel pulverizing device of the aspect of the present invention, the reference pressure, the predetermined pressure, and the predetermined flow rate are each appropriately set, making it possible to immediately detect rapid combustion that occurs in the housing interior. Further, the solid fuel pulverizing device transitions to a stopped state upon detection of both a rise in the internal pressure of the housing and a decrease in the flow rate of the primary air. As a result, the solid fuel pulverizing device can prevent false detection of rapid combustion caused by detector failure when either one of the detectors fails. In particular, the solid fuel pulverizing device can prevent false detection of rapid combustion caused by failure of the internal pressure detector configured to detect the internal pressure of the housing where the pulverized solid fuel exists.

In the solid fuel pulverizing device according to another aspect of the present invention, the pulverized fuel classified by the classifier may be supplied to a burner unit configured to burn the pulverized fuel, and the internal pressure detector may be configured to detect the internal pressure of the housing relative to a reference pressure with an internal pressure of a furnace of a boiler including the burner unit set as the reference pressure.

Here, the location where the internal pressure of the housing is detected may be any position inside the housing. For example, the interior of the classifier may be set as the detection location, or the exterior of the classifier may be set as the detection location.

According to the solid fuel pulverizing device of this configuration, the internal pressure detector detects the internal pressure of the housing with the internal pressure of the furnace of the boiler set as the reference pressure. The internal pressure of the furnace of the boiler that serves as the reference pressure is the pressure of a space near the burner unit that burns the pulverized fuel supplied from the solid fuel pulverizing device. The internal pressure of the furnace of the boiler has a relationship of synchronization with the internal pressure of the housing, and thus the internal pressure of the housing detected by the internal pressure detector significantly changes when rapid combustion occurs. As a result, according to this configuration, the solid fuel pulverizing device can reliably detect the occurrence of rapid combustion, perform control, and transition to a stopped state.

In the solid fuel pulverizing device according to another aspect of the present invention, the internal pressure detector may be configured to detect the internal pressure of the housing relative to a reference pressure with atmospheric pressure or vacuum pressure set as the reference pressure.

This makes it possible to detect the occurrence of rapid combustion using the internal pressure detector configured to detect a gauge pressure with atmospheric pressure as the reference or detect an absolute pressure with vacuum pressure as the reference, perform control, and transition the solid fuel pulverizing device to a stopped state.

In the solid fuel pulverizing device according to another aspect of the present invention, the solid fuel pulverizing device may further include a temperature detector configured to detect a temperature of an outlet through which the pulverized fuel is discharged from the housing. In such a device, the controller performs control and transition the solid fuel pulverizing device to a stopped state when the temperature of the outlet detected by the temperature detector is a predetermined temperature or higher.

According to this configuration, when one or both of the internal pressure detector and the flow rate detector fails or the like, the solid fuel pulverizing device can appropriately detect the occurrence of rapid combustion by the temperature detector even if the occurrence of rapid combustion cannot be appropriately detected by the internal pressure detector and the flow rate detector.

In the solid fuel pulverizing device according to another aspect of the present invention, the controller may perform control and transition the solid fuel pulverizing device to a stopped state by stopping ventilation with the primary air by the ventilation unit.

According to this configuration, the controller can transition the solid fuel pulverizing device to a stopped state by stopping ventilation with the primary air by the ventilation unit and depleting the primary air that burns the solid fuel.

In the solid fuel pulverizing device according to another aspect of the present invention, the solid fuel pulverizing device includes the fuel supply unit, and the controller may perform control and transition the solid fuel pulverizing device to a stopped state by stopping supply of the solid fuel to the rotary table by the fuel supply unit.

According to this configuration, the controller can transition the solid fuel pulverizing device to a stopped state by stopping the supply of the solid fuel to the rotary table by the fuel supply unit and depleting the solid fuel.

In the solid fuel pulverizing device of the configuration described above, the solid fuel pulverizing device may further include a supply flow channel configured to allow the pulverized fuel to be supplied to the burner unit, and an on-off valve provided to the supply flow channel. In such a device, the controller may perform control and transition the solid fuel pulverizing device to a stopped state by turning off the on-off valve.

This makes it possible to prevent the transmission of a high temperature, high pressure air stream caused by the occurrence of rapid combustion to the burner unit, and reliably seal the pulverized fuel and the primary air inside the housing.

A method for controlling a solid fuel pulverizing device according to another aspect of the present invention is a method for controlling a solid fuel pulverizing device. The device includes a rotary table, a roller, a classifier, a housing, and a ventilation unit. The rotary table is configured to rotate by a driving force from a drive unit. The roller is configured to pulverize the solid fuel supplied from a fuel supply unit to the rotary table. The classifier is configured to classify the solid fuel pulverized by the roller into pulverized fuel smaller than a predetermined particle size. The housing houses the rotary table, the roller, and the classifier. The ventilation unit is configured to ventilate an interior of the housing with primary air for supplying the solid fuel pulverized by the roller to the classifier. Such a method includes the steps of detecting an internal pressure of the housing relative to a reference pressure, detecting a flow rate of the primary air blown into the interior of the housing by the ventilation unit, and performing control and transitioning the solid fuel pulverizing device to a stopped state upon the internal pressure detected in the step for detecting the internal pressure being a predetermined pressure or higher, and the flow rate of the primary air detected in the step for detecting the flow rate being a predetermined flow rate or less.

According to the method for controlling a solid fuel pulverizing device of the aspect of the present invention, control is performed and the solid fuel pulverizing device transitions to a stopped state when rapid combustion occurs inside the housing that houses the rotary table, the roller, and the classifier, causing the internal pressure of the housing to rise to a predetermined pressure or higher relative to the reference pressure, and the flow rate of the primary air to decrease to a predetermined flow rate or less.

According to the method for controlling a solid fuel pulverizing device of the aspect of the present invention, the reference pressure, the predetermined pressure, and the predetermined flow rate are each appropriately set, making it possible to immediately detect rapid combustion that occurs inside the housing. Further, the solid fuel pulverizing device transitions to a stopped state upon detection of both a rise in the internal pressure of the housing and a decrease in the flow rate of the primary air. As a result, the solid fuel pulverizing device can prevent false detection of rapid combustion caused by detector failure when either one of the detectors fails. In particular, the solid fuel pulverizing device can prevent false detection of rapid combustion caused by failure of the internal pressure detector configured to detect the internal pressure of the housing where the pulverized solid fuel exists.

Advantageous Effects of Invention

According to the present invention, it is possible to provide a solid fuel pulverizing device that immediately detects rapid combustion that occurs therein and, at the same time, prevents false detection caused by failure of a detector configured to detect rapid combustion, and a method for controlling the solid fuel pulverizing device.

DESCRIPTION OF EMBODIMENTS

Figure 1:
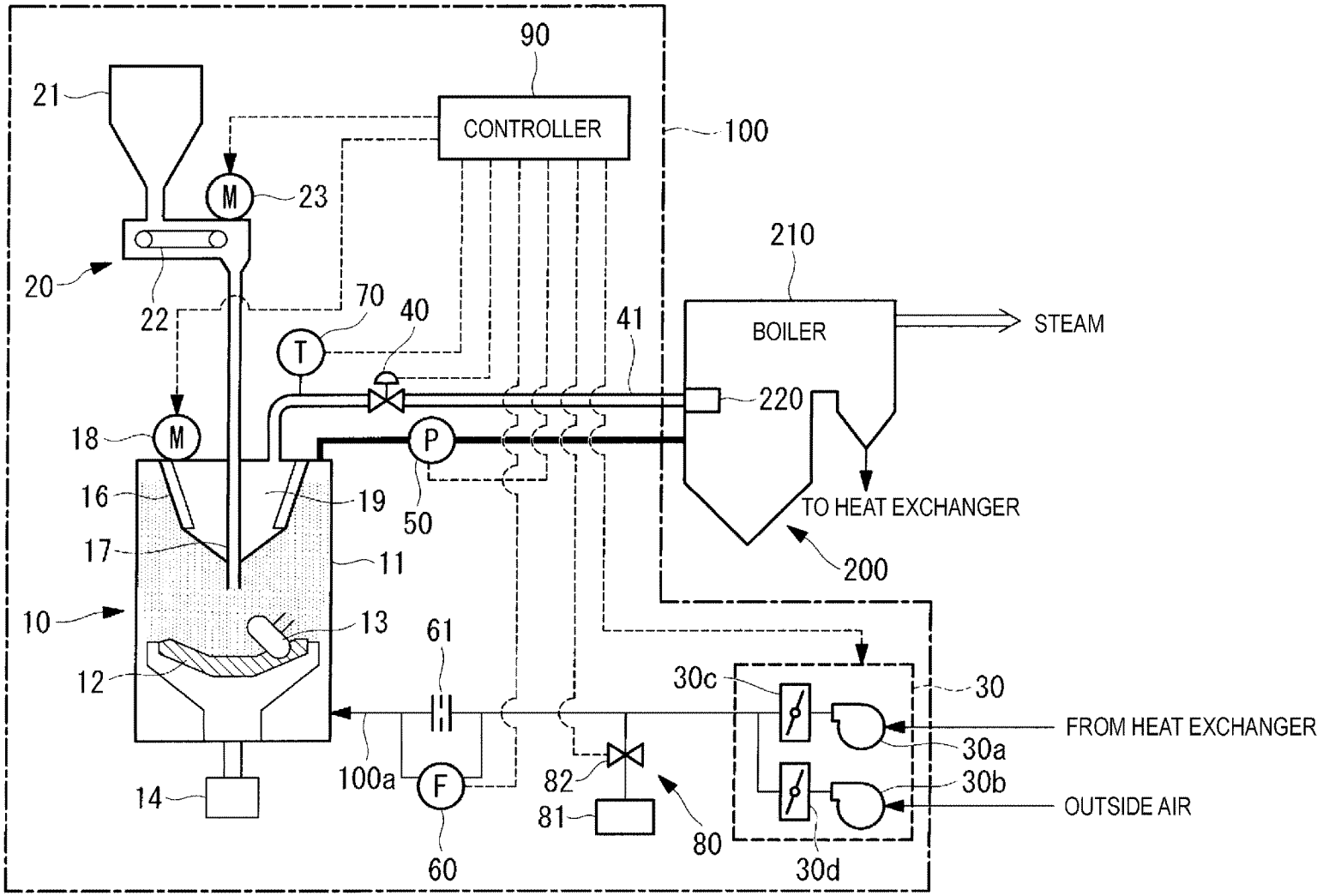
FIG. 1 is a configuration diagram illustrating a solid fuel pulverizing device and a boiler of an embodiment of the present invention.

The following describes a solid fuel pulverizing device and a method for controlling the solid fuel pulverizing device of an embodiment of the present invention, with reference to the drawings.

A solid fuel pulverizing device 100 of the present embodiment is a device that pulverizes a solid fuel such as coal, generates a pulverized fuel, and supplies the pulverized fuel to a boiler 200.

The solid fuel pulverizing device 100 of the present embodiment includes a mill 10, a coal feeder 20 (fuel supply unit), a ventilation unit 30, an on-off valve 40, a pressure detector 50, a flow rate detector 60, a temperature detector 70, a nitrogen gas supply unit 80, and a controller 90.

The mill 10 includes a housing 11, a rotary table 12, a roller 13, a drive unit 14, a drive shaft (not illustrated), a classifier 16, a fuel supply unit 17, and a motor 18.

The housing 11 is formed into a cylindrical shape that extends in a vertical direction, and serves as a housing that houses the rotary table 12, the roller 13, the classifier 16, and the fuel supply unit 17.

The rotary table 12 is a member that has a circular shape in a plan view and rotates by a driving force from the drive unit 14. The rotary table 12 is supplied with a solid fuel from the fuel supply unit 17.

A plurality of nozzles (not illustrated) that discharge primary air that flows in through a primary air flow channel 100*a* to a space above the rotary table 12 in the housing 11 are provided on an outer side of the rotary table 12. Vanes (not illustrated) are disposed above the nozzles, and impart a swirling force to the primary air blown from the nozzles. The primary air imparted with the swirling force by the vanes forms a swirling air stream having a speed component, and introduces the solid fuel pulverized on the rotary table 12 into the classifier 16 located above the housing 11. Note that, among the pulverized matter of the solid fuel mixed into the primary air, pulverized matter having a large particle size falls without reaching the classifier 16 and is once again returned to the rotary table 12.

The roller 13 is a rotating body that pulverizes the solid fuel supplied from the fuel supply unit 17 to the rotary table 12. The roller 13 is pressed to an outer circumferential portion of the rotary table 12 and cooperates with the rotary table 12 to pulverize the solid fuel.

While only one roller 13 is illustrated in FIG. 1, a plurality of rollers 13 are disposed at constant intervals in a circumferential direction and press the outer circumferential portion of the rotary table 12. For example, three rollers 13 are disposed on the outer circumferential portion at angular intervals of 120°. In this case, the sections (pressed sections) where the three rollers 13 come into contact with the outer circumferential portion of the rotary table 12 are equidistant from a center of the rotary table 12.

The drive unit 14 is a device that transmits a rotational force to the rotary table 12 via the drive shaft, and rotates the rotary table about a central axis.

The classifier 16 is a device that classifies the solid fuel pulverized by the rollers 13 into a pulverized fuel smaller than a predetermined particle size (75 μm, for example). The classifier 16 includes a plurality of classifying blades that rotate about a cylindrical shaft of the housing 11 having a substantially cylindrical shape. The classifying blades of the classifier 16 are imparted with a driving force by the motor 18 and rotate about the cylindrical shaft of the housing 11.

Among the pulverized matter of the solid fuel that reaches the classifier 16, the pulverized fuel smaller than a predetermined particle size is introduced into an outlet 19 by a relative balance between a centrifugal force produced by the rotation of the classifying blades and a centripetal force caused by the air stream of the primary air.

The pulverized fuel classified by the classifier 16 is discharged from the outlet 19 to the supply flow channel 41. The pulverized fuel that flows out to the supply flow channel 41 passes through the on-off valve 40 and is supplied to a burner unit 220 of the boiler 200.

The fuel supply unit 17 is attached passing through an upper end of the housing 11, and supplies the solid fuel fed from the upper portion to the center of the rotary table 12. The fuel supply unit 17 is supplied with solid fuel from the coal feeder 20.

The coal feeder 20 includes a hopper 21, a transport unit 22, and a motor 23. The transport unit 22 transports solid fuel discharged from a lower end portion of the hopper 21 by a driving force imparted from the motor 23, introducing the solid fuel to the fuel supply unit 17 of the mill 10.

The ventilation unit 30 is a device configured to ventilate the interior of the housing 11 with primary air for supplying the solid fuel pulverized by the rollers 13 to the classifier 16.

The ventilation unit 30 includes a hot gas blower 30*a*, a cold gas blower 30*b*, a hot gas damper 30*c*, and a cold gas damper 30*d*.

The hot gas blower 30*a* is a blower that blows heated primary air supplied from a heat exchanger. The hot gas damper 30*c* is provided to a downstream side of the hot gas blower 30*a*. A degree of opening of the hot gas damper 30*c* is controlled by the controller 90. The degree of opening of the hot gas damper 30*c* determines a flow rate of the primary air blown by the hot gas blower 30*a*.

The cold gas blower 30*b* is a blower that blows primary air, which is normal temperature outside air. The cold gas damper 30*d* is provided to the downstream side of the cold gas blower 30*b*. A degree of opening of the cold gas damper 30*d* is controlled by the controller 90. The degree of opening of the cold gas damper 30*d* determines a flow rate of the primary air blown by the cold gas blower 30*b*.

The on-off valve 40 is a valve provided to the supply flow channel 41 configured to allow the pulverized fuel discharged from the outlet 19 to be supplied to the burner unit 220. The on-off valve 40 is controlled in an on state or an off state by the controller 90.

The pressure detector 50 is a sensor that detects the internal pressure of the housing 11 relative to the reference pressure. The pressure detector 50 detects the internal pressure of the housing 11 with the internal pressure of a furnace 210 of a boiler 200 set as the reference pressure. Accordingly, the pressure detector 50 illustrated in FIG. 1 is a sensor that detects the pressure differential between the internal pressure of the furnace 210 of the boiler 200 and the internal pressure of the housing 11.

The pressure detector 50 outputs the detected pressure differential between the internal pressure of the furnace 210 of the boiler 200 and the internal pressure of the housing 11 to the controller 90.

The flow rate detector 60 is a sensor that detects the flow rate of the primary air blown by the ventilation unit 30 into the interior of the housing 11 via the primary air flow channel 100*a*. The flow rate detector 60 detects the flow rate of the primary air that passes through the primary air flow channel 100*a* by detecting the pressure differential between the pressure on an upstream side and the pressure on the downstream side of an orifice 61 disposed in the primary air flow channel 100*a*.

The flow rate detector 60 outputs the detected flow rate of the primary air that flows through the primary air flow channel 100*a* to the controller 90.

The temperature detector 70 is a sensor that detects the temperature of the supply flow channel 41 near the outlet 19. The temperature detector 70 detects the temperature of the pulverized fuel discharged from the outlet 19, and outputs the temperature to the controller 90.

The nitrogen gas supply unit 80 includes a nitrogen gas supply source 81 and a regulating valve 82. The controller 90 controls the regulating valve 82, making it possible to regulate the amount of nitrogen gas (inert gas) supplied to the primary air flow channel 100*a*. When rapid combustion occurs inside the housing 11 and the controller 90 transitions the solid fuel pulverizing device 100 to a stopped state, the nitrogen gas is supplied to the primary air flow channel 100*a* to stop the rapid combustion.

Note that while the nitrogen gas supply unit 80 supplies nitrogen gas to the primary air flow channel 100*a* above, the nitrogen gas may be directly supplied to the interior of the housing 11 of the solid fuel pulverizing device 100 without passing through the primary air flow channel 100*a*.

The controller 90 is a device that controls each unit of the solid fuel pulverizing device 100. The controller 90 controls the revolution speed of the rotary table 12 by transmitting a drive instruction to the drive unit 14. Further, the controller 90 transmits a revolution speed instruction to the motor 23 of the coal feeder 20, making it possible to regulate the solid fuel supply amount transported and fed to the fuel supply unit 17 by the transport unit 22.

Further, the controller 90 can control the degree of opening of the hot gas damper 30*c* and the cold gas damper 30*d* by transmitting a degree of opening instruction to the ventilation unit 30.

Further, the controller 90 can transmit an on-off instruction to the on-off valve 40 to perform control so that the on-off valve 40 is turned to on or off.

Further, the controller 90 can control the degree of opening of the regulating valve 82 by transmitting a degree of opening instruction to the nitrogen gas supply unit 80.

Next, the boiler 200 that performs combustion using the pulverized fuel supplied from the solid fuel pulverizing device 100 to produce steam will be described.

The boiler 200 includes the furnace 210 and the burner unit 220.

The burner unit 220 is a device that burns the pulverized fuel using the primary air that includes the pulverized fuel supplied from the supply flow channel 41 and secondary air supplied from the heat exchanger (not illustrated). The burning of the pulverized fuel is performed inside the furnace 210, and high temperature combustion gas passes through an economizer (not illustrated) and is subsequently discharged outside the boiler 200.

The combustion gas discharged from the boiler 200 is fed to the heat exchanger (not illustrated) where heat exchange is performed with outside air. The outside air heated by the heat exchange with the combustion gas in the heat exchanger is fed to the hot gas blower 30*a* described above.

The water heated in the economizer (not illustrated) is further heated by an evaporator (not illustrated) and a superheater (not illustrated), and turns into steam. The steam is then fed to a steam turbine (not illustrated).

Next, the process of immediately detecting rapid combustion when rapid combustion occurs inside the housing and transitioning the solid fuel pulverizing device 100 to a stopped state will be described.

Figure 2:
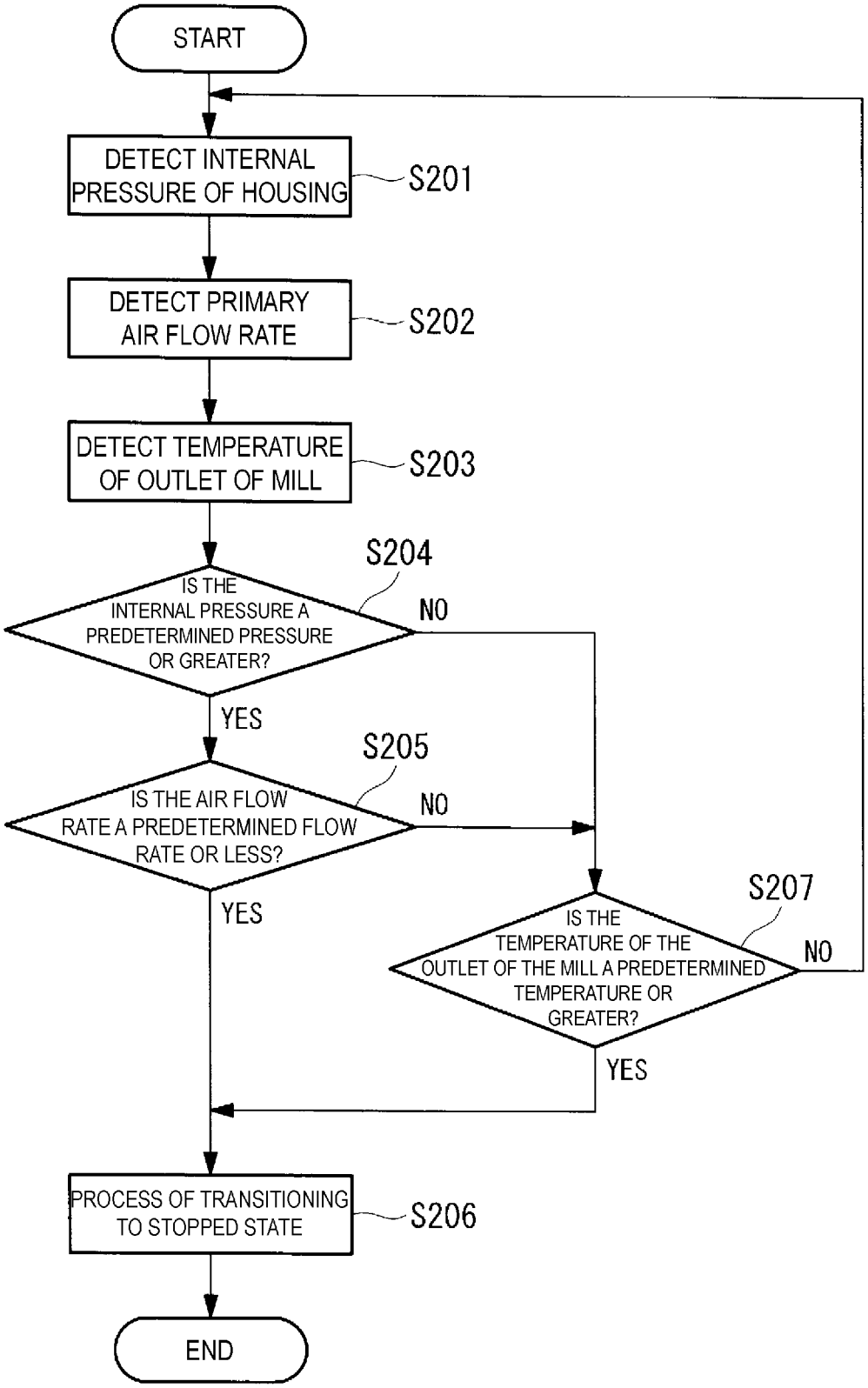
FIG. 2 is a flowchart illustrating a process executed by the solid fuel pulverizing device of the embodiment.

Each process of the flowchart illustrated in FIG. 2 is executed by the controller 90 reading and executing a control program stored in a storage unit (not illustrated). The following describes each process in the flowchart illustrated in FIG. 2.

In step S201, the controller 90 receives a detection signal of the internal pressure of the housing 11 from the pressure detector 50, and detects the internal pressure of the housing 11.

In step S202, the controller 90 receives a detection signal of the flow rate of the primary air that flows in the housing 11 from the flow rate detector 60, and detects the flow rate of the primary air.

In step S203, the controller 90 receives a detection signal of the temperature of the outlet 19 of the mill 10 from the temperature detector 70, and detects the temperature of the outlet 19 of the mill 10.

In step S204, the controller 90 determines whether or not the internal pressure of the housing 11 detected in step S201 is a predetermined pressure or higher. The controller 90 advances the process to step S205 if it has been determined that the internal pressure is the predetermined pressure or higher, and advances the process to step S207 if not.

Figure 3:
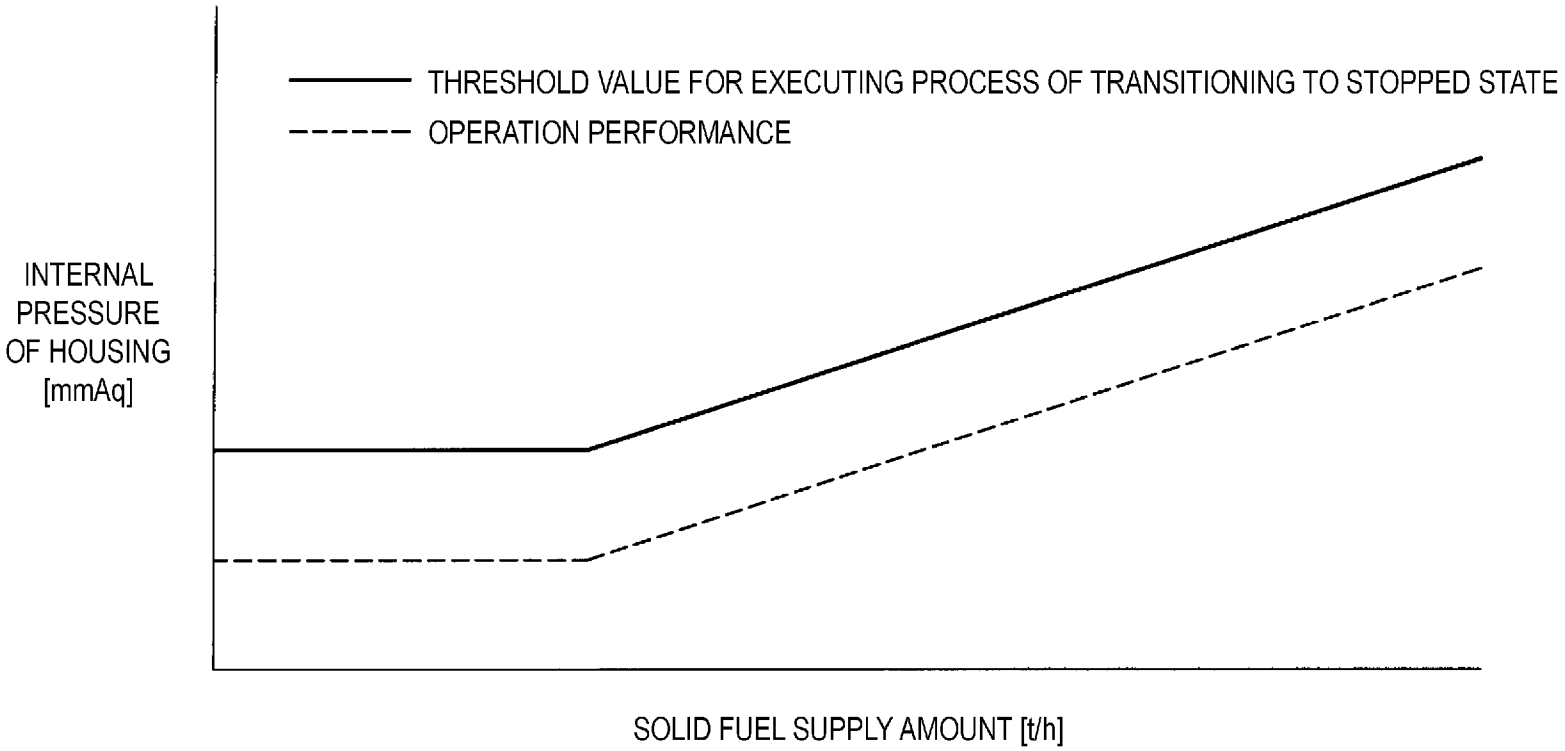
FIG. 3 is a diagram illustrating a relationship between a solid fuel supply amount and an internal pressure of a housing.

Here, the controller 90 determines whether or not the internal pressure of the housing 11 is a predetermined pressure or higher on the basis of a threshold value indicated by the solid line in FIG. 3. Specifically, the controller 90 determines the threshold value of the internal pressure of the housing 11 from the current solid fuel supply amount [t/h] with reference to FIG. 3, and determines "YES" in step S204 when the internal pressure of the housing 11 detected in step S201 is this threshold value or higher.

The threshold value indicated by the solid line in FIG. 3 is a value for determining whether or not the transition process of transitioning the solid fuel pulverizing device 100 to a stopped state is to be executed. The threshold value indicated by the solid line in FIG. 3 is a value that associates the solid fuel supply amount [t/h] with the internal pressure of the housing 11 (with the internal pressure of the furnace 210 serving as the reference pressure).

The value indicated by the dashed line in FIG. 3 indicates the operation performance of the solid fuel pulverizing device 100, and is a value that associates the solid fuel supply amount [t/h] and the internal pressure of the housing 11 (with the internal pressure of the furnace 210 serving as the reference pressure).

The internal pressure of the housing 11 indicated by the threshold value of the solid line in FIG. 3 is higher than that indicated by the value of the dashed line in FIG. 3. Accordingly, when the internal pressure of the housing 11 is higher than the threshold value indicated by the solid line in FIG.

3 with respect to a certain solid fuel supply amount [t/h], rapid combustion has occurred inside the housing 11.

In step S205, the controller 90 determines whether or not the flow rate of the primary air that flows in the housing 11 detected in step S202 is a predetermined flow rate or less. The controller 90 advances the process to step S206 if it has been determined that the flow rate is the predetermined flow rate or less, and advances the process to step S207 if not.

Figure 4:
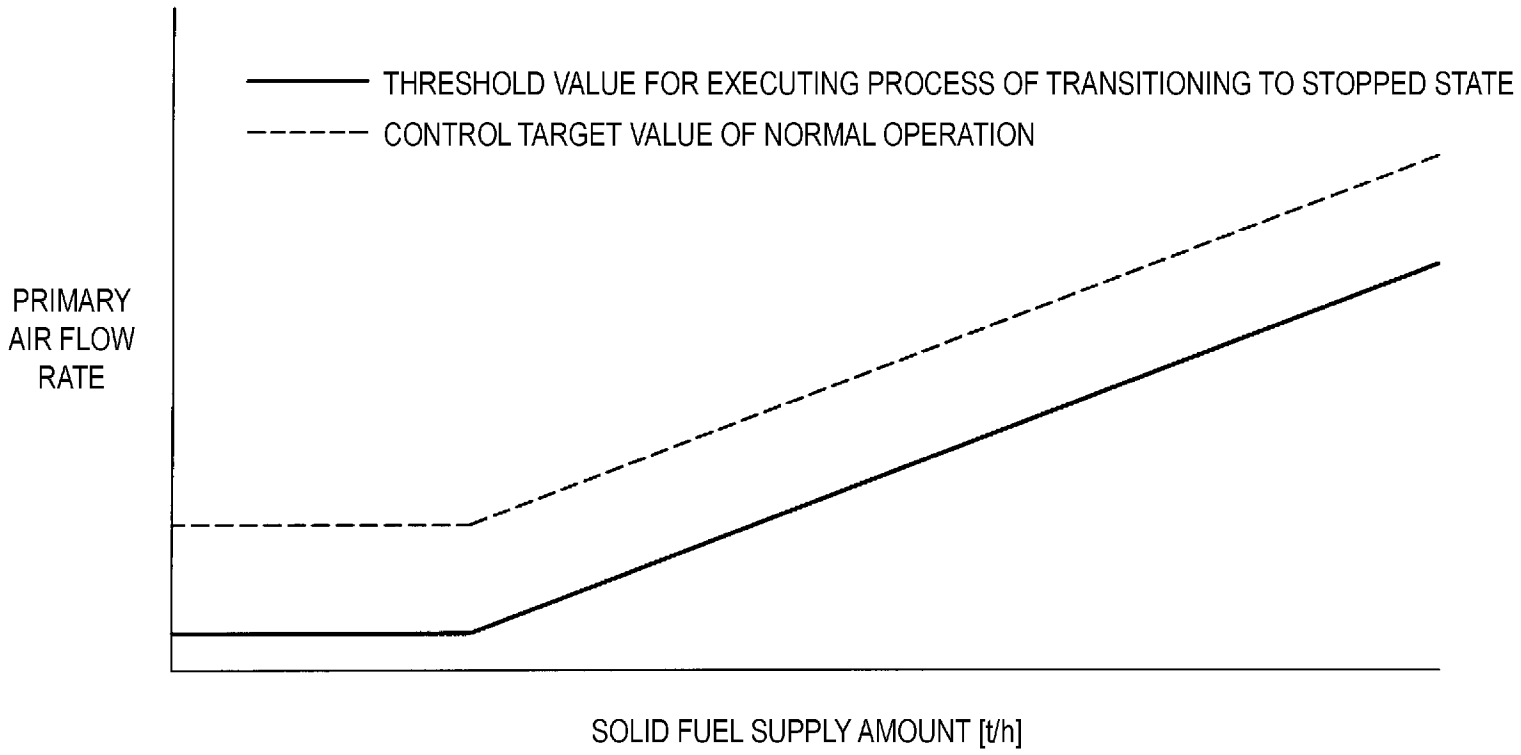
FIG. 4 is a diagram illustrating a relationship between the solid fuel supply amount and a primary air flow rate.

Here, the controller 90 determines whether or not the flow rate of the primary air that flows into the housing 11 is a predetermined flow rate or less on the basis of a threshold value indicated by the solid line in FIG. 4. Specifically, the controller 90 determines the threshold value of the flow rate of the primary air that flows into the housing 11 from the current solid fuel supply amount [t/h] with reference to FIG. 4, and determines "YES" in step S205 if the flow rate of the primary air detected in step S202 is this threshold value or less.

The threshold value indicated by the solid line in FIG. 4 is a value for determining whether or not the transition process of transitioning the solid fuel pulverizing device 100 to a stopped state is to be executed. The value indicated by the solid line in FIG. 4 is a value that associates the solid fuel supply amount [t/h] with the flow rate of the primary air that flows in the housing 11.

The threshold value indicated by the dashed line in FIG. 4 indicates a control target value of normal operation, and is a value that associates the solid fuel supply amount [t/h] with the flow rate of the primary air that flows in the housing 11.

The flow rate of the primary air indicated by the threshold value of the solid line in FIG. 4 is less than that indicated by the value of the dashed line in FIG. 4. Thus, when the flow rate of the primary air is less than the threshold value indicated by the solid line in FIG. 4 with respect to a certain solid fuel supply amount [t/h], rapid combustion has occurred inside the housing 11 and primary air cannot be sufficiently supplied to the housing 11.

In step S206, because the pressure detected by the pressure detector 50 in step S201 is a predetermined pressure or higher and the primary air flow rate detected by the flow rate detector 60 in step S202 is a predetermined flow rate or less, the controller 90 executes a transition process of transitioning the solid fuel pulverizing device 100 to a stopped state. That is, the controller 90 determines that rapid combustion has occurred inside the housing 11, and transitions the solid fuel pulverizing device 100 to a stopped state.

In step S206, the controller 90 turns off the hot gas damper 30*c* and the cold gas damper 30*d* of the ventilation unit 30, and stops ventilation with the primary air by the ventilation unit 30.

Further, the controller 90 controls and turns on the regulating valve 82 so that nitrogen gas (inert gas) is supplied to the interior of the housing 11.

Further, the controller 90 stops the motor 23 of the coal feeder 20, and stops the supply of solid fuel to the rotary table 12 from the fuel supply unit 17.

Further, the controller 90 performs controls and makes the on-off valve 40 to turn off.

Further, the controller 90 controls the drive unit 14 and stops the rotation of the rotary table 12.

Thus, as described above, the controller 90 transitions each unit of the solid fuel pulverizing device 100 to a stopped state, thereby transitioning the entire solid fuel pulverizing device 100 to a stopped state. Note that the transition process of transitioning to a stopped state may further include emission of various warnings.

In step S207, the controller 90 determines whether or not the temperature of the outlet 19 of the mill 10 is a predetermined temperature or higher. The controller 90 advances the process to step S206 if it has been determined that the temperature is the predetermined temperature or higher, and advances the process to step S201 if not.

Step S207 is a process for transitioning the solid fuel pulverizing device 100 to a stopped state due to determination that rapid combustion occurred inside the housing 11 when a temperature of the outlet 19 of the mill 10 has reached a predetermined temperature or higher (100° C. or higher, for example), even when neither the detection result of the pressure detector 50 nor the detection result of the flow rate detector 60 indicates rapid combustion inside the housing 11. For example, when one or both of the pressure detector 50 and the flow rate detector 60 fails, the process of step S207 is enabled.

The actions and effects exhibited by the above-described solid fuel pulverizing device 100 of the present embodiment will now be described.

According to the solid fuel pulverizing device 100 of the present embodiment, when rapid combustion occurs inside the housing 11 that houses the rotary table 12, the roller 13, and the classifier 16, the internal pressure of the housing 11 rises due to the rapid combustion and, as a result, the flow rate of the primary air blown inside the housing 11 decreases.

The solid fuel pulverizing device 100 according to the present embodiment performs control and transitions to a stopped state when, due to rapid combustion that occurred inside the housing 11, the internal pressure of the housing 11 rises to a predetermined pressure or higher relative to the reference pressure (internal pressure of the furnace 210), and the flow rate of the primary air is a predetermined flow rate or less.

According to the solid fuel pulverizing device 100 of the present embodiment, the reference pressure (internal pressure of the furnace 210), the predetermined pressure (threshold value indicated in FIG. 3), and the predetermined flow rate (threshold value indicated in FIG. 4) are each appropriately set, making it possible to immediately detect rapid combustion that occurs inside the housing 11. Further, the solid fuel pulverizing device 100 transitions to a stopped state upon detection of both a rise in the internal pressure of the housing 11 and a decrease in the flow rate of the primary air. As a result, the solid fuel pulverizing device 100 can prevent false detection of rapid combustion caused by detector failure when either of the detectors fails. In particular, the solid fuel pulverizing device 100 can prevent false detection of rapid combustion caused by failure of the pressure detector 50 configured to detect the internal pressure of the housing 11 where the pulverized solid fuel exists.

Further, according to the solid fuel pulverizing device 100 of the present embodiment, the pressure detector 50 detects the internal pressure of the housing 11 with the internal pressure of the furnace 210 of the boiler 200 set as the reference pressure. The internal pressure of the furnace 210 of the boiler 200 that serves as the reference pressure is the pressure of the space near the burner unit 220 that burns the pulverized fuel supplied from the solid fuel pulverizing device 100. The internal pressure of the furnace 210 of the boiler 200 has a relationship of synchronization with the internal pressure of the housing 11. Thus, when rapid combustion occurs, the internal pressure of the housing 11 detected by the pressure detector 50 significantly changes. As a result, according to the present embodiment, the solid fuel pulverizing device 100 can reliably detect the occurrence of rapid combustion. As a result, the solid fuel pulverizing device 100 can perform control and transition to a stopped state.

Further, in the solid fuel pulverizing device 100 of the present embodiment, the controller 90 performs control and transitions the solid fuel pulverizing device 100 to a stopped state when the temperature of the outlet 19 detected by the temperature detector 70 is a predetermined temperature or higher.

According to the present embodiment, when one or both of the pressure detector 50 and the flow rate detector 60 fails or the like, the solid fuel pulverizing device 100 can appropriately detect the occurrence of rapid combustion by the temperature detector 70 even if the occurrence of rapid combustion cannot be appropriately detected by the pressure detector 50 and the flow rate detector 60.

Further, in the solid fuel pulverizing device 100 of the present embodiment, the controller 90 performs control and transitions the solid fuel pulverizing device 100 to a stopped state by stopping the ventilation with primary air by the ventilation unit 30.

According to the present embodiment, the controller 90 can transition the solid fuel pulverizing device 100 to a stopped state by stopping ventilation with the primary air by the ventilation unit 30 and depleting the primary air that burns the solid fuel.

In the solid fuel pulverizing device 100 of the present embodiment, the controller 90 performs control and transition the solid fuel pulverizing device 100 to a stopped state by stopping supply of the solid fuel to the rotary table 12 by the fuel supply unit 17.

According to the present embodiment, the controller 90 can transition the solid fuel pulverizing device 100 to a stopped state by stopping the supply of the solid fuel to the rotary table 12 by the fuel supply unit 17 and depleting the solid fuel.

The solid fuel pulverizing device 100 of the present embodiment includes the supply flow channel 41 configured to allow pulverized fuel discharged from the outlet 19 to be supplied to the burner unit 220, and the on-off valve 40 provided to the supply flow channel 41. Then, the controller 90 performs control and transitions the solid fuel pulverizing device 100 to a stopped state by turning off the on-off valve 40.

This makes it possible to prevent the transmission of a high temperature, high pressure air stream caused by the occurrence of rapid combustion to the burner unit 220, and reliably seal the pulverized fuel and the primary air inside the housing 11.

Other Embodiments

While in the above description the pressure detector 50 sets the internal pressure of the furnace 210 of the boiler 200 as the reference pressure, other embodiments are possible. For example, atmospheric pressure or vacuum pressure may be used as the reference pressure.

This makes it possible to detect the occurrence of rapid combustion using the pressure detector 50 configured to detect a gauge pressure with atmospheric pressure as the reference or detect an absolute pressure with vacuum pressure as the reference, perform control, and transition the solid fuel pulverizing device 100 to a stopped state.

REFERENCE SIGNS LIST

10 Mill
11 Housing
12 Rotary table
13 Roller
14 Drive unit
16 Classifier
17 Fuel supply unit
20 Coal feeder
30 Ventilation unit
**30*a*** Hot gas blower
**30*b*** Cold gas blower
**30*c*** Hot gas damper
**30*d*** Cold gas damper
40 On-off valve
50 Pressure detector (internal pressure detector)
60 Flow rate detector
61 Orifice
70 Temperature detector
82 Regulating valve
90 Controller
100 Solid fuel pulverizing device
**100*a*** Primary air flow channel
200 Boiler
220 Burner unit

The invention claimed is:

1. A solid fuel pulverizing device configured to pulverize a solid fuel, the device comprising:

a rotary table configured to rotate by a driving force from a drive unit;

a roller configured to pulverize the solid fuel supplied from a fuel supply unit to the rotary table;

a classifier configured to classify the solid fuel pulverized by the roller into pulverized fuel smaller than a predetermined particle size;

a housing that houses the rotary table, the roller, and the classifier;

a ventilation unit configured to ventilate an interior of the housing with primary air for supplying the solid fuel pulverized by the roller to the classifier;

an internal pressure detector configured to detect an internal pressure of the housing relative to a reference pressure;

a flow rate detector configured to detect a flow rate of the primary air blown into the interior of the housing by the ventilation unit; and a controller configured to perform control and transition the solid fuel pulverizing device to a stopped state upon the internal pressure detected by the internal pressure detector being a predetermined pressure or higher and the flow rate of the primary air detected by the flow rate detector being a predetermined flow rate or less.

2. The solid fuel pulverizing device according to claim 1, wherein:

the pulverized fuel classified by the classifier is supplied to a burner unit configured to burn the pulverized fuel, and the internal pressure detector detects the internal pressure of the housing relative to a reference pressure with an internal pressure of a furnace of a boiler including the burner unit set as the reference pressure.

3. The solid fuel pulverizing device according to claim 2, further comprising: a temperature detector configured to detect a temperature of an outlet through which the pulverized fuel is discharged from the housing, the controller performing control and transitioning the solid fuel pulverizing device to a stopped state upon the temperature of the outlet detected by the temperature detector being a predetermined temperature or higher.

4. The solid fuel pulverizing device according to claim 3, wherein the controller performs control and transitions the solid fuel pulverizing device to a stopped state by stopping ventilation with the primary air by the ventilation unit.

5. The solid fuel pulverizing device according to claim 3, comprising the fuel supply unit;

the controller performing control and transitioning the solid fuel pulverizing device to a stopped state by stopping supply of the solid fuel to the rotary table by the fuel supply unit.

6. The solid fuel pulverizing device according to claim 2, wherein the controller performs control and transitions the solid fuel pulverizing device to a stopped state by stopping ventilation with the primary air by the ventilation unit.

7. The solid fuel pulverizing device according to claim 2, comprising the fuel supply unit;

the controller performing control and transitioning the solid fuel pulverizing device to a stopped state by stopping supply of the solid fuel to the rotary table by the fuel supply unit.

8. The solid fuel pulverizing device according to claim 1, wherein the internal pressure detector detects the internal pressure of the housing relative to a reference pressure with atmospheric pressure or vacuum pressure set as the reference pressure.

9. The solid fuel pulverizing device according to claim 8, further comprising: a temperature detector configured to detect a temperature of an outlet through which the pulverized fuel is discharged from the housing, the controller performing control and transitioning the solid fuel pulverizing device to a stopped state upon the temperature of the outlet detected by the temperature detector being a predetermined temperature or higher.

10. The solid fuel pulverizing device according to claim 9, wherein the controller performs control and transitions the solid fuel pulverizing device to a stopped state by stopping ventilation with the primary air by the ventilation unit.

11. The solid fuel pulverizing device according to claim 8, wherein the controller performs control and transitions the solid fuel pulverizing device to a stopped state by stopping ventilation with the primary air by the ventilation unit.

12. The solid fuel pulverizing device according to claim 8, comprising the fuel supply unit;

the controller performing control and transitioning the solid fuel pulverizing device to a stopped state by stopping supply of the solid fuel to the rotary table by the fuel supply unit.

13. The solid fuel pulverizing device according to claim 1, further comprising: a temperature detector configured to detect a temperature of an outlet through which the pulverized fuel is discharged from the housing, the controller performing control and transitioning the solid fuel pulverizing device to a stopped state upon the temperature of the outlet detected by the temperature detector being a predetermined temperature or higher.

14. The solid fuel pulverizing device according to claim 13, wherein the controller performs control and transitions the solid fuel pulverizing device to a stopped state by stopping ventilation with the primary air by the ventilation unit.

15. The solid fuel pulverizing device according to claim 13, comprising the fuel supply unit;

the controller performing control and transitioning the solid fuel pulverizing device to a stopped state by stopping supply of the solid fuel to the rotary table by the fuel supply unit.

16. The solid fuel pulverizing device according to claim 1, wherein the controller performs control and transitions the solid fuel pulverizing device to a stopped state by stopping ventilation with the primary air by the ventilation unit.

17. The solid fuel pulverizing device according to claim 16, further comprising:

a supply flow channel configured to allow the pulverized fuel to be supplied to a burner unit; and an on-off valve provided to the supply flow channel;

the controller performing control and making the solid fuel pulverizing device to transition to a stopped state by turning off the on-off valve.

18. The solid fuel pulverizing device according to claim 16, comprising the fuel supply unit;

the controller performing control and transitioning the solid fuel pulverizing device to a stopped state by stopping supply of the solid fuel to the rotary table by the fuel supply unit.

19. The solid fuel pulverizing device according to claim 1, comprising the fuel supply unit;

the controller performing control and transitioning the solid fuel pulverizing device to a stopped state by stopping supply of the solid fuel to the rotary table by the fuel supply unit.

20. A method for controlling a solid fuel pulverizing device comprising a rotary table configured to rotate by a driving force from a drive unit, a roller configured to pulverize the solid fuel supplied from a fuel supply unit to the rotary table, a classifier configured to classify the solid fuel pulverized by the roller into pulverized fuel smaller than a predetermined particle size, a housing that houses the rotary table, the roller, and the classifier, and a ventilation unit configured to ventilate an interior of the housing with primary air for supplying the solid fuel pulverized by the roller to the classifier, the method comprising the steps of:

detecting an internal pressure of the housing relative to a reference pressure;

detecting a flow rate of the primary air blown into the interior of the housing by the ventilation unit; and performing control and transitioning the solid fuel pulverizing device to a stopped state upon the internal pressure detected in the step for detecting the internal pressure being a predetermined pressure or higher, and the primary air flow rate detected in the step for detecting the flow rate being a predetermined flow rate or less.

* * * * *